US006474296B2

(12) United States Patent
Cornell et al.

(10) Patent No.: US 6,474,296 B2
(45) Date of Patent: Nov. 5, 2002

(54) LASH ADJUSTMENT FOR USE WITH AN ACTUATOR

(75) Inventors: Sean O. Cornell, Pontiac, IL (US); Scott A. Leman, Eureka, IL (US); David E. Martin, Normal, IL (US); Ronald D. Shinogle, Peoria, IL (US); Virl R. Voights, Sreator, IL (US); Mingchun Dong, Elmhurst, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/740,436

(22) Filed: Dec. 19, 2000

(65) Prior Publication Data

US 2002/0124822 A1 Sep. 12, 2002

(51) Int. Cl.[7] ..... F02D 13/04

(52) U.S. Cl. ..... 123/321; 123/320; 123/322; 123/90.4

(58) Field of Search ..... 123/90.12, 90.15, 123/90.16, 90.39, 90.4, 90.45, 90.46, 320, 321, 322

(56) References Cited

U.S. PATENT DOCUMENTS

| | | | | |
|---|---|---|---|---|
| 2,044,522 A | | 6/1936 | Wurtele | |
| 2,071,719 A | | 2/1937 | Wurtele | |
| 2,072,437 A | | 3/1937 | Wurtele | |
| 2,082,853 A | | 6/1937 | Stoikowitz | |
| 2,171,668 A | | 9/1939 | Oldham | |
| 2,191,333 A | | 2/1940 | Willgoos | |
| 2,280,386 A | | 4/1942 | Dickson | |
| 2,595,775 A | | 5/1952 | Wrangell | |
| 2,650,579 A | | 9/1953 | Bernight | |
| 2,935,979 A | | 5/1960 | Havens | |
| 3,021,593 A | | 2/1962 | Cousino | |
| 3,812,829 A | | 5/1974 | McCormick | |
| 4,020,803 A | | 5/1977 | Thuren et al. | |
| 4,058,091 A | | 11/1977 | Tanahashi | |
| 4,169,488 A | | 10/1979 | Goloff et al. | |
| 4,653,726 A | | 3/1987 | Lang et al. | |
| 4,674,450 A | | 6/1987 | Krajancich | |
| 4,809,655 A | | 3/1989 | Mahler | |
| 5,168,843 A | | 12/1992 | Franks | |
| 5,201,290 A | * | 4/1993 | Hu | 123/321 |
| 5,596,964 A | | 1/1997 | Kurihara | |
| 5,619,961 A | | 4/1997 | Diggs | |
| 5,682,846 A | | 11/1997 | Scharnweber | |
| 5,709,178 A | | 1/1998 | Feucht | |
| 5,713,315 A | | 2/1998 | Jyoutaki et al. | |
| 5,713,316 A | | 2/1998 | Sturman | |
| 5,829,397 A | * | 11/1998 | Vorih | 123/90.12 |
| 5,992,376 A | * | 11/1999 | Okada | 123/321 |
| 6,062,025 A | * | 5/2000 | Okada | 60/602 |
| 6,321,701 B1 | * | 11/2001 | Vorih | 123/90.12 |

FOREIGN PATENT DOCUMENTS

| | | | | |
|---|---|---|---|---|
| JP | 403111611 A | * | 5/1991 | 123/90.12 |

* cited by examiner

*Primary Examiner*—Thomas Denion
*Assistant Examiner*—Jaime Corrigan
(74) *Attorney, Agent, or Firm*—Larry G Cain

(57) ABSTRACT

An actuator for adjusting a clearance between an end of a valve and an end of the actuator. The actuator has a piston therein having a central bore of which a portion is threaded. The piston has an end and has a flat defined near the end. The actuator has a stem member positioned therein. The stem member has a central portion which is threadedly positioned within the threaded portion of the central bore. The stem member defines a first end and a second end, and a threaded portion is located near the second end. The first end of the stem member and the end of the piston has a predetermined length which is adjustable. The predetermined length is adjusted by threadedly rotating the stem member relative to the piston. A locking device fixes the predetermined length during operation of the engine.

8 Claims, 3 Drawing Sheets

LASH ADJUSTMENT FOR USE WITH AN ACTUATOR

TECHNICAL FIELD

The invention relates to an internal combustion engine or compressor having an actuator and more particularly to an adjusting apparatus and method for setting a lash between the actuator and a driven component such as a valve.

BACKGROUND ART

In a conventional engine a cam shaft drives a push rod, a rocker arm and in turn an intake or exhaust valve. To provide a compression braking system for such engines in the past has required adding additional components. For example, a housing having a fluid circuit therein is actuated by a solenoid. A control valve enables a flow of low pressure fluid to fill connecting passages and an actuator having a cavity and a master piston. The push rod actuates the master piston and with the control valve closed the slave piston is forced to open the exhaust valve during the preestablished cycle of braking. Thus, to adapt a conventional engine for use with the compression braking system has not been cost effective.

Additionally, when such component parts are initially installed and after use wear will occur. Thus, such component parts must be adapted to allow adjustment thereof. In present compression braking systems, an external adjusting screw is used to vary the relative position of the actuator to the exhaust valve.

In future applications, a camless engine is perceived and an actuator for the intake and exhaust valve can be hydraulically actuated. One such example is shown in U.S. Pat. No. 5,638,781 issued to Oded E. Sturman on Jun. 17, 1997. In Sturman's patent a solenoid actuates a fluid control valve moving a spool into an open position. With the spool moved to the open position, hydraulic fluid acts on a stem of the valve and the valve moves off its seat into the open position. Lineal adjustment of the components before assembly or after operation of the engine and during working relationship of the engine fails to be shown or considered.

The present invention is directed to overcoming one or more of the problems as set forth above.

DISCLOSURE OF THE INVENTION

In one aspect of the invention an engine has a cylinder and has a piston therein. A pair of valves are operatively positioned relative to the piston. The pair of valves are actuated by a valve bridge. The valve bridge is actuated by a cam shaft and moves the valves between an open position and a closed position during an operating mode of the engine. The engine has a controller operatively attached thereto. An actuator is attached to the engine. The actuator is spaced from the pair of valves a predetermined distance and one of the pair of valves is movable between an open position and a closed position by the actuator independently of the actuation of the pair of valves being actuated by the valve bridge and the cam shaft.

In another aspect of the invention a method of adjusting a clearance between an actuator and an end of a valve is provided. The method has the steps of retaining a first end of the actuator in a fixed non-rotating position. Releasing a locking device. Rotating a second end of the actuator. And, tightening the locking device after the clearance has been adjusted.

In another aspect of the invention an actuator is provided. The actuator has a first end and a second end. The actuator is adapted for use in an engine to adjust a clearance between a valve having an end and the first end of the actuator. The actuator has a cylindrical member having a first end and a second end, and an inner diameter extending between the first end and the second end. A piston has a body portion defining an outer diameter positioned within the inner diameter of the cylindrical member. A stem portion defines a first end being attached to the body portion and a second end has a flat thereon. The stem portion has an outer diameter and a central bore having a stepped configuration. The central bore is positioned in the body portion and the stem portion. A portion of the central bore is threaded. A stem member has a first end portion defining a first end and has a flat thereon, and a second end portion defines a second end and has a threaded portion thereon. And, the stem member has a central portion being threaded. The stem member is at least partially positioned within the piston and the threaded central portion is threadedly engaged with the threaded portion of the central bore. A cover has a central bore defined therein being positioned about the outer diameter of the stem portion and is attached to the cylindrical member. The piston, the cylindrical member and the cover define a cavity therebetween. And, a locking device is threadedly attached to the threaded portion of the stem member.

BEST MODE FOR CARRYING OUT THE INVENTION

Figure 1:
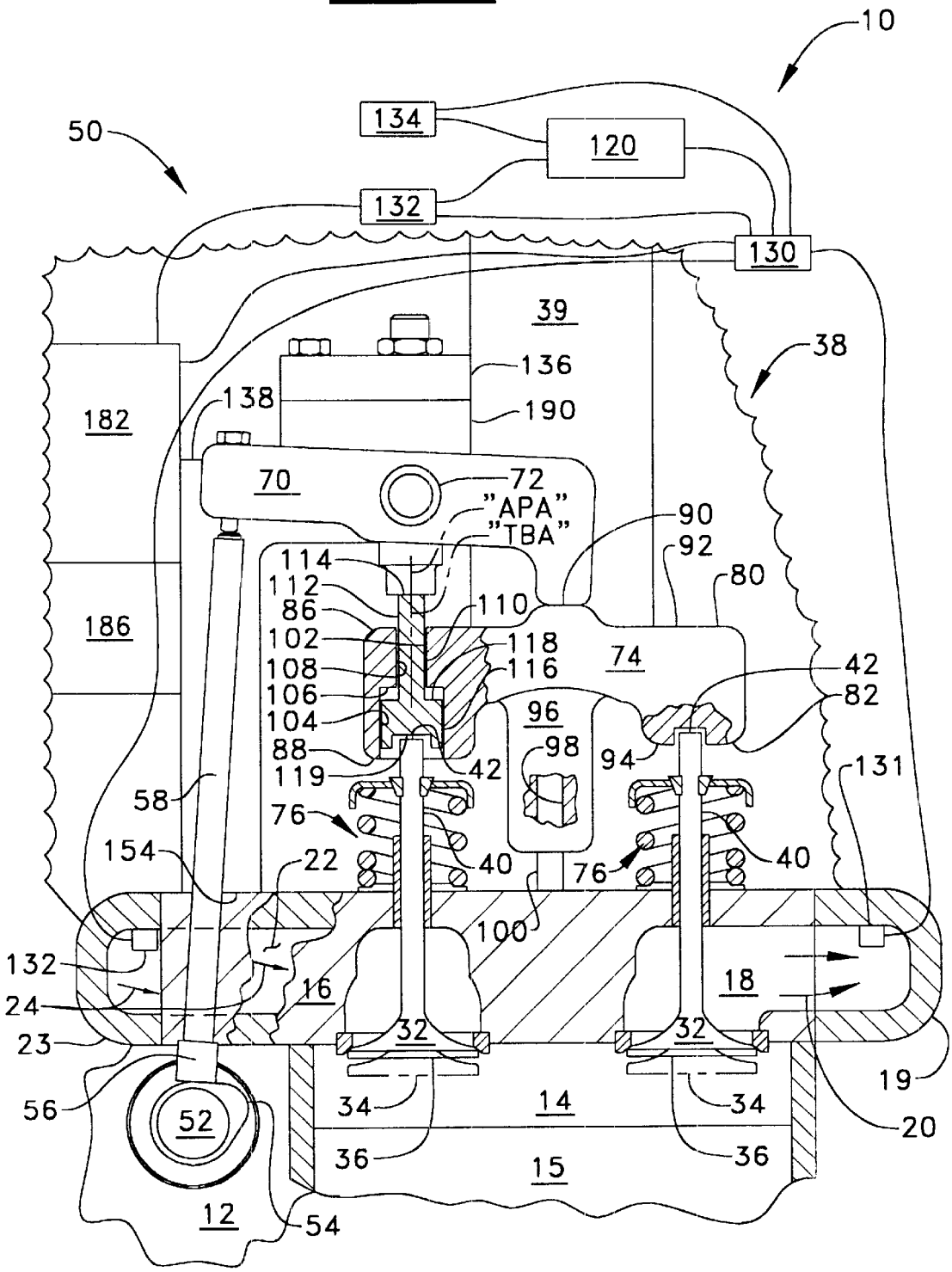
FIG. 1 is a partially sectioned view of an engine embodying the present invention.

Referring to FIG. 1, an engine 10 includes a block 12 and has a plurality of cylinder 14 therein, of which only one is shown. A piston 15 is positioned in each of the plurality of cylinders 14 in a conventional manner and travel through a plurality of conventional strokes, such as intake, compression, power and exhaust. A cylinder head 16 is attached to the block 12 in a conventional manner. The cylinder head 16 includes an exhaust passage 18 and has an exhaust manifold 19 attached thereto. Each of the exhaust passage 18 and the exhaust manifold 19 has a flow of exhaust gas designated by the arrows 20 therein. The cylinder head 16 has an intake passage 22 therein and an intake manifold 23 attached thereto. Each of the intake passage 22 and the intake manifold 23 has a flow of intake air designated by the arrows 24 therein. An intake valve or in this application a pair of intake valves, not shown, are interposed the intake passage 22 and the respective one of the plurality of cylinders 14 in a conventional manner and operatively moves between an open position and a closed position. An exhaust valve 32 or in this application a pair of exhaust valves, are interposed the exhaust passage 18 and the respective one of the plurality of cylinders 14 and operatively moves between an open position 34, shown in phantom, and a closed position 36.

A fuel injection system, not shown, is attached to the engine 10 in a conventional manner. A flow of combustible fuel, not shown, and a plurality of injectors 39, only one being shown, are operative connected to a respective ones of the plurality of cylinder 14. The plurality of injectors 39 can be of conventional construction, such as, pump and lines or unit injectors. As a further alternative, a carburetored fuel system could be used.

Each of the intake valves 26 and the exhaust valves 32 define a stem 40 having an end 42.

In this application, the operation of the intake valves 26 and the exhaust valves 32 are actuated by a valve train assembly 50 in a conventional manner during a normal engine 10 operating mode. And, since the present invention utilizes only the exhaust valves 32 only the components of the valve train assembly 50 used with the exhaust valves 32 will be explained in detail. The valve train assembly 50 has a cam shaft 52 rotatably mounted in the engine 10 in a conventional manner. As an alternative, the cam shaft 52 could be mounted in the block 12 or the cylinder head 16 without changing the jest of the invention. The cam shaft 52 has a plurality of lobes 54 thereon. During rotation of the cam shaft 52 the plurality of lobes 54 operative contact a cam follower 56, which is in operational relationship with a push rod 58. As an alternative, the cam follower 56 could be in operational relationship with the exhaust valves 32 eliminating the push rod 58. The push rod 58 is in operational relationship with a rocker arm 70. And, the rocker arm is rotatably mounted about a shaft 72 within the engine 10 in a conventional manner. In this application, the rocker arm 70 is in operational relationship with a valve bridge 74 which operates the pair of exhaust valves 32 simultaneously. As an alternative, the rocker arm 70 could operate a single exhaust valve 32. A conventional valve arrangement 76 has a spring or springs, rotator and keepers.

Figure 2:
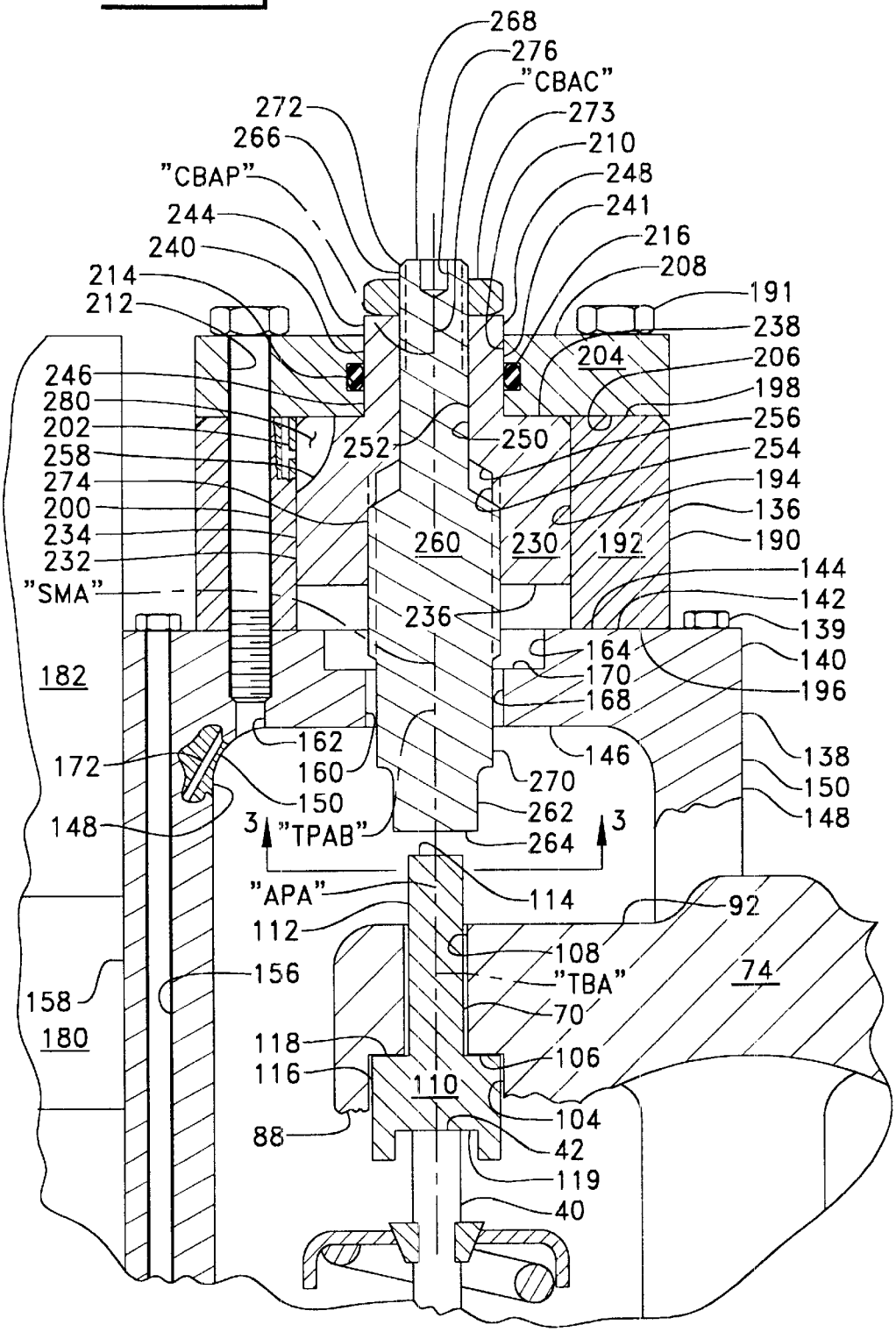
FIG. 2 is an enlarged partially sectional view of the present invention.

In this application, the valve bridge 74 is in contacting relationship with the end 42 of the stem 40 of the pair of exhaust valves 32. As shown in FIGS. 1 and 2, the valve bridge 74 has a first end portion 80 defining a first seat portion 82 being in operational relationship with the end 42 of one of the plurality of exhaust valves 32. A second end portion 86 of the valve bridge 74 defines a second seat portion 88 being in operational relationship with the end 42 of another one of the plurality of exhaust valves 32 of a same one of the plurality of cylinders 14. A contacting portion 90 is interposed the first and second end portions 80,86 and is positioned on a first side 92 of the valve bridge 74. Opposite the first side 92 of the valve bridge 74 is a second side 94 on which the first seat portion 82 and the second seat portion 88 are positioned. The contacting portion 90 is in operational relationship with the rocker arm 70. The valve bridge 74 further has a cylindrical portion 96 attached to the second side 94 opposite the contacting portion 90. In some applications, a bottomed bore 98 is positioned within the cylinder portion 96 and is slidably position about a slide pin 100 connected within the cylinder head 16.

In this application, at least one of the first seat portion 82 or the second seat portion 88 has a through bore 102 having a stepped configuration therein. The through bore 102 is formed about an axis designated as "TBA" by a first diameter 104 extending from the second side 94 toward the first side 92 a predetermined distance and terminating at an actuator surface 106. A second diameter 108 of the through bore 102 extends from the actuator surface 106 to the first side 92. An actuation pin 110 is positioned in the through bore 102. The actuator pin 110 is formed about an axis designated as "APA" and has a hat configuration being formed by a top portion 112 and is slidably positioned in the second diameter 108. A top surface 114 has a preestablished cross-sectional area designated by "TSCA" and is formed at an extremity of the top portion 112. The top surface 114 extends above the first side 92 of the valve bridge 74 a predetermined distance. A brim portion 116 of the actuator pin 110 has a contacting surface 118 being attached to an end of the top portion 112 opposite the top surface 114. The contacting surface 118 has a preestablished cross-sectional area and is slidably positioned within the first diameter 104 of the through bore 102. The brim portion 116 has a valve surface 119 positioned opposite the contacting surface 118. As an alternative, the bore 102 could be a slot or have another configuration other than circular.

As an option in this application, one of the exhaust valves 32 is to be used in conjunction with a compression braking system 120 and the engine 10 is placed in a braking mode. Or, as a further alternative, an addition valve mechanism or brake valve, not shown, could be positioned in operating relationship with one or a plurality of the cylinders 14 for use with the compression braking system 120.

The compression brake system 120 has a controller 130 attached to the engine 10 and a plurality of sensors 131 communicate therewith. A communication system 132 is used to operationally communicate with an operator and the controller 130. And, an actuation system 134 is in communication with the controller 130 in a conventional manner.

The actuation system 134 has an actuator 136 connected to a bracket 138. The bracket 138 is removably attached to the cylinder head 16 of the engine 10 in spaced relationship to the valve bridge 74 and the valve arrangement 76. For example, a plurality of bolts 139 are threaded attached to respective threaded holes, not shown, in the cylinder head 16. The bracket 138 could be a fixed part of the cylinder head 16 without changing the jest of the invention. The bracket 138 has a top portion 140 having a first side 142 defining a generally flat surface 144 thereon and a second side 146 spaced from the first side 142. A pair of spaced apart legs 148 define a first end portion 150. The first end portion 150 is attached to the second side 146 of the top portion 140. A second end 152 of the pair of legs 148 has a generally flat surface 154 in contact with the cylinder head 16. The flat surface 144 of the top portion 140 and the flat surface 154 of the legs 148 are generally parallel. A bore 156 is positioned through each of the legs 148 and is interposed the first side 142 of the top portion 140 and the flat surface 154 of the legs 148. One of the legs 148 has a mounting surface 158 thereon. The top portion 140 has a through passage 160 therein extending between the first side 142 and the second side 146. The through passage 160 is centered about an axis "TPAB". A plurality of threaded holes 162 are arranged about the through passage 160 in a preestablished relationship. In this application, the through passage 160 has a stepped configuration and defines a first bore 164 having a first diameter extending from the first side 142 and a second bore 168. In this application the second bore is defined by a slot 168 having a flat thereon. The second diameter is smaller than the first diameter. The first bore 164 and the second bore 168 meet at a plane 170 interposed the first side 142 and the second side 146. A bore 172 is interposed the flat surface 144 of the top portion 140 and the mounting surface 158 of the leg 148.

At least one of the legs 148 has a block 180 mounted thereon at the mounting surface 158. As an alternative the block 180 and the bracket 138 could be formed integrally. A switch mechanism 182 is attached to the block 180 and communicates with the controller 130 and the communication system 132 in a conventional manner, such as by electrical, hydraulic or manual elements.

Attached to the flat surface 144 of the top portion 140 is a mechanism 190 by a plurality of fasteners 191. In this application the mechanism 190 has a cylindrical configuration but could be of another configuration without changing the jest of the invention. The mechanism 190 includes a cylindrical member 192 defining an inner diameter 194 having a preestablished diameter and has a preestablished wall thickness. The cylindrical member 192 has a first end 196 and a second end 198. A plurality of through bores 200 extend between the first end 196 and the second end 198. The plurality of bores 200 have the same preestablished relationship as does the plurality of threaded holes 162 in the bracket 138. A passage 202 extends between the first end 196 and the inner diameter 194. The Passage 202 exits through the inner diameter 194 near the second end 198.

The cylindrical mechanism 190 includes a cover 204 defining a first surface 206 being in contacting sealing relationship with the second end 198 of the cylindrical member 192. The cover 204 and the cylindrical member 192 could be formed integrally without changing the jest of the invention. A second surface 208 is spaced from the first surface 206 a preestablished distance forming a thickness of the cover 204. A central bore 210 extends between the first surface 206 and the second surface 208 and is positioned about an axis "CBAC". A plurality of bores 212 extend between the first surface 206 and the second surface 208 of the cover 204 and have the same preestablished relationship as does the plurality of threaded holes 162 in the bracket 138 and the plurality of bores 200 in the cylindrical member 192. A groove 214 is positioned in the central bore 210 intermediate the first surface 206 and the second surface 208. A seal 216 is positioned in the groove 214. The plurality of fasteners 191 extend through the plurality of bores 212 in the cover 204 and the plurality of bores 200 in the cylindrical member 192 and threadedly engage the plurality of threaded holes 162 in the bracket 138.

The cylindrical mechanism 190 includes a piston 230 of which a portion thereof is positioned within the inner diameter 194 of the cylindrical member 192. For example, a body portion 232 of the piston 230 has an outer diameter 234 being generally sealingly and movably positioned in the inner diameter 194 between a first end 236 and a second end 238. A stem portion 240 of the piston 230 has an outer diameter positioned sealingly and movably within the central bore 210 of the cover 204. As an alternative, the seal 216 can be eliminated and the clearance or fit between the outer diameter 241 of the stem portion 240 and the central bore 210 be designed such to provide a sliding and sealing relationship, as is known in the art. The outer diameter extends between a first end portion 244 and a second end portion 246. The second end portion 246 is unitary with the second end 238 of the body portion 232. The outer diameter of the stem portion 240 has a flat 248 or hex configuration formed thereon near the first end 244 and extending toward the second end 246.

A central bore 250 extends through the body portion 232 and the stem portion 240 between the first end 236 of the body portion 232 and the first end 244 of the stem portion 240. The central bore 250 is centered about an axis "CBAP". The central bore 250 has a stepped configuration. Extending from the first end 244 of the stem portion 240 toward the first end 236 of the body portion 232. A first diameter 252 has a preestablished diameter and length. A second diameter 254 extends from the first end 236 of the body portion 232 toward the first end 244 of the stem portion 240. The second diameter 254 has a threaded configuration defining a preestablished length from the first end 236 of the body portion 232. The first diameter 252 and the second diameter 254 intersect by way of a tapered portion 256. The second end 238 of the body portion 232 has a recess or notch 258 positioned therein and extending into the outer diameter 234 a predetermined depth from the second end 238.

Figure 3:
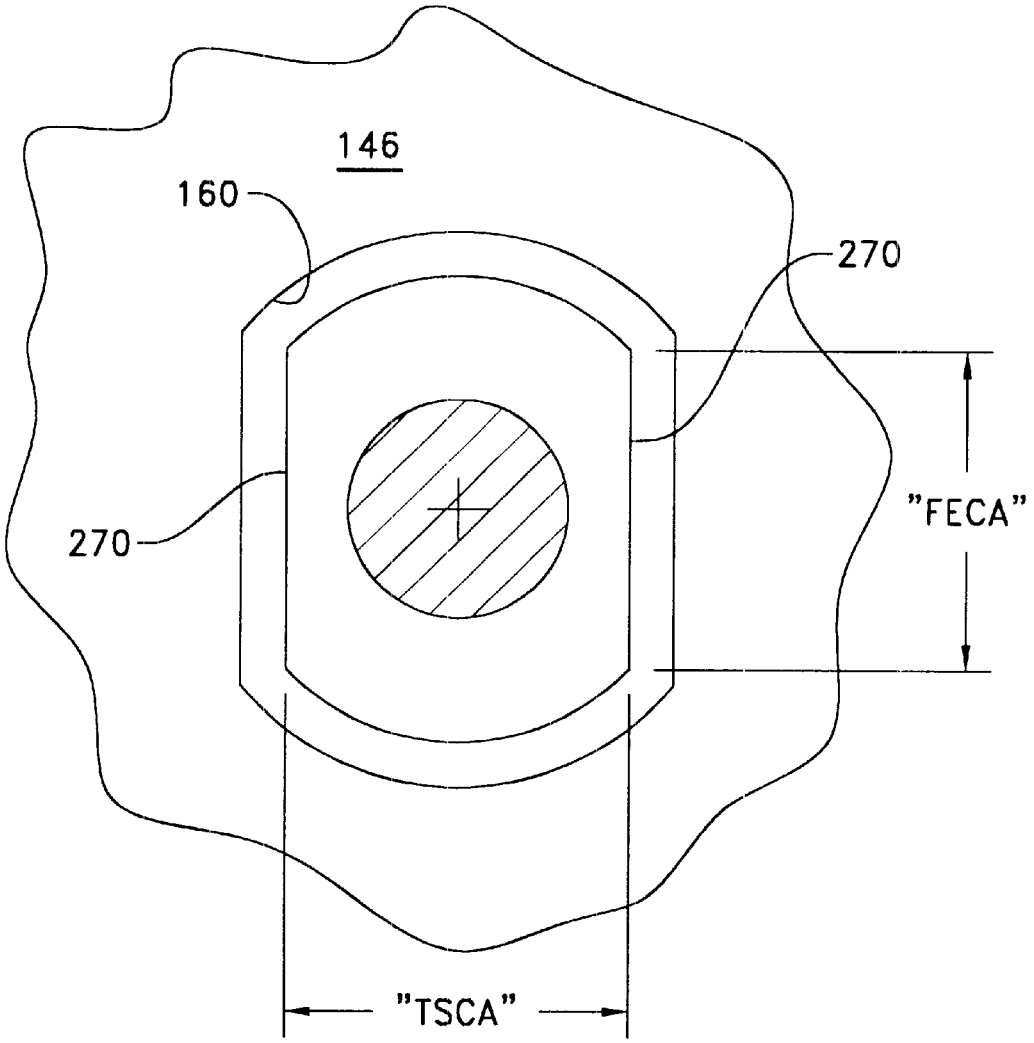
FIG. 3 is bottom view taken along line 3—3 of FIG. 2.

The cylindrical mechanism 190 includes a stem member 260 having a generally cylindrical configuration defined about an axis "SMA". The stem member 260 has a first end portion 262 having a first end 264 and a second end portion 266 having a second end 268. The first end 264 has a preestablished cross-sectional area, as best shown in FIG. 3, designated by "FECA" extending about the axis "SMA". The first end portion 262 has a flat 270, or in this application a pair of flats or hexagon configuration, extending from the first end 264 toward the second end 268 a predetermined distance. The second end portion 266 has a threaded portion 272 extending from the second end 268 toward the first end 264 a predetermined distance. A locking device 273, such as a nut in this application, is threadedly attached to the threaded portion 272. As an alternative, if the second end 268 is positioned within the first diameter 252 and a portion of the first diameter 252 is threaded, a bolt can be threadedly engaged with the threaded portion of the first diameter 252 and an end of the bolt can abut with the second end 268 of the stem member 260 and act as the locking device 273. A cross-sectional area of the second end portion 266 is fitted within the first diameter 252 of the stem portion 240 of the piston 230. A center portion 274 of the stem member 260 has a predetermined diameter which is threadedly formed to mesh and engage with the threaded configuration of the second diameter 254 of the body portion 232. In this application, the second end 268 has a countersunk hex configuration 276.

The switch mechanism 182 in this application has an on mode and an off mode of which a signal from the controller 130 by way of the communication system 132 defines. For example, in the on mode a pressurized fluid within the block 180, such as oil or diesel fuel, is communicated to a chamber 280 formed between the cover 204, the cylindrical member 192 and the piston 230. The pressurized fluid axially moves the piston 230 and the first end 264 of the stem member 260 toward the top surface 114 of the actuator pin 110. Thus, the first end 264 of the stem member 260 is in contacting relationship with the top surface 114 of the actuator 110. And, the valve surface 119 of the actuator pin 110 is in contacting relationship with the end 42 of the stem 40 and moves the exhaust valve 32 into the open position 34. And, in the off mode the pressurized fluid is generally void within the chamber 280 and the actuator pin 110 is in non-contacting relationship with the end 42 of the stem 40. As an alternative, not shown, the stem member 260 could have a contacting member positioned therein extending through the through bore 102 and result in contact with the end 42 of the stem 40 of the exhaust valve 32.

INDUSTRIAL APPLICABILITY

In use, the engine 10 is started. Fuel is supplied to each of the plurality of cylinders 14 by the respective fuel injector 39 of the fuel injection system 38. Intake air 24 is supplied to the engine 10 by way of the intake valves and mixes with the fuel, burns and functionally operates the engine 10 in a conventional manner. In the normal operating mode of the engine 10, the cam shaft 52 is rotated and the plurality of lobes 54 move the push rod 58 axially. The axial movement applies a force on an end of the rocker arm 70 causing the rocker arm to pivot and linearly moves the valve bride 74. The lineal movement moves either the pair of intake valves 26 or the pair of exhaust valve 32 in a normal manner to the open position 28,34. And, as the cam shaft 52 continues to rotate, the pair of intake valves 26 and the pair of exhaust valves 32 are moved into the closed position 30, 36.

With the present invention a conventional engine 10 can be adapted to have the compression braking system 120. The compression braking system 120 is supplement to the vehicle of machined braking system. For example, the actuator 136 is assembled separately. The threads on the center portion 274 of the stem member 260 are threadedly attached to the threaded configuration of the second diameter 254 of the piston 230. The dimension of the axially length or desired gap between the surface 114 on the actuator pin 110 and the first end 264 on the stem member 260 is determined and maintained by threadedly attaching the nut 273 to the threaded portion 272 at the second end portion of the stem member 260. The nut 273 is tightened on the threaded portion 272 and is placed in contacting relationship with the first end 244 of the stem portion 240 of the piston 230. Thus, the meshed threads of the threads on the center portion 274 of the stem member 260 are maintained in highly frictional engagement with the threaded configuration of the second diameter 254 of the piston 230. The outer diameter 234 of the body portion 232 of the piston 230 is slidably positioned within the inner diameter 194 of the cylindrical member 192. The seal 216 is positioned in the groove 214 within the central bore 210 of the cover 204. The central bore 210 and the seal 216 are slidably positioned about the outer diameter of the stem portion 240 of the piston 230. And, the plurality of bores 212 are aligned with the plurality of bores 200 in the cylindrical member 192. The passage 202 of the cylindrical member 192 is aligned with bore 172 exiting the flat surface 144 of the top portion 140 of the mounting surface 158 of the leg 148 of the bracket 138. The plurality of bores 200 in the cylindrical member 192 and the plurality of bores 212 in the cover 204 are aligned with the plurality of threaded holes 162 in the bracket 138. Thus, the axis "TPAB" of the through passage 160 in the bracket 138, the axis "CBAC" of the central bore 210 in the cover 204, the axis "CBAP" of the central bore 250 in the piston 230, and the axis "SMA" of the stem member 260 are aligned and coincide one with another. The plurality of fasteners 191 attach the cover 204 and the cylindrical member 192 to the bracket 138. The block 180 is operationally aligned with the bore 172 exiting the mounting surface 158 on the leg 148 of the bracket 138. And, the switch mechanism 182 is operatively mounted to the block 180. The bracket 138 and the actuator 136 are attached to the cylinder head 16 of the engine 10. During the attachment of the bracket 138 and the actuator 136, the axis "SMA" of the first end 164 of the stem member 260 and the axis "APA" of the top surface 114 of the actuator pin 110 are substantially aligned. Functionally, if a portion of the cross-sectional area "TSCA" the top surface 114 and the cross-sectional area "FECA" of the first surface 264 of the stem member 260 are aligned the exhaust valve 32 will be moved to the open position 34 by the actuator 136. The actuation system 134 and the communication system 132 are operatively attached to the engine 10 and controller 130.

During the operation of the engine 10, the operator selects the braking mode. For example, the communication system 132 transmits a signal to the controller 130 and the braking mode is actuated. The controller 130 by use of the plurality of sensors 131 functionally actuates the actuation system 134 when feasible without causing malfunction of the engine 10, such as, intake valve and/or exhaust valve 32 interfering with the piston 15.

The communication system 132 also transmits a signal to the actuation system 134 to actuated the switch mechanism 182 into the on mode and the contents of the block 180 reacts. Thus, the pressurized fluid enters the cavity 280 and forces the piston 230 and the stem member 260 to move linearly. The stem member 260 moves the actuator pin 110 into contact with the end 42 of the exhaust valve 32. The pressure within the cavity 280 forces the exhaust valve 32 into the open position 34. Ideally, to obtain maximum braking, the exhaust valve 32 is opened at or near the top end of the compression stroke of one of the plurality of cylinders 14. Thus, compressed air enters the exhaust manifold 19 and during the intake stroke of another one of the plurality of cylinders 14 the communication system 132 also transmits a signal to the actuation system 134 to actuated the switch mechanism 182 into the on mode. This results in the pressured fluid entering the cavity 280 and forces the piston 230 and the stem member 260 to move linearly. The stem member 260 moves the actuator pin 110 into contact with the end 42 of the exhaust valve 32. The pressure within the cavity 280 forces the exhaust valve 32 into the open position 34. Thus, pressurized air from the exhaust manifold 19 enters during the intake stroke and additional energy is expanded by the engine 10 during the respective compression stroke and additional braking is provided.

During assembly of the engine 10 and operation fits vary and components wear, thus, relationships and fits change. Thus, to compensate for these changes, the actuator 136 is made to be adjustable. For example, the flat 248 is engaged with a wrench and a second wrench is used to loosen the locking device 273. Thus, the flat 270 on the stem member 260 and the flat within the bore 160 are engaged and the stem member 260 is maintained stationary. And, by rotating the piston 230 the threaded connection of the second diameter 254 of the body portion 232 and the threaded portion of the central portion 274 of the stem member 260 the axial distance between the first end 264 of the stem member 260 and the first end 236 of body portion 232 is varied to a new predetermined distance. This results in the spacing or clearance between the first end 264 of the stem member 260 and the surface 114 of the actuator pin 110 being adjusted to a predetermined distance and the spacing or clearance between the surface 119 of the actuator pin 110 and the end 42 of the valve 40 being controlled, varied and adjustable to the predefined preestablished distance. As an alternative, with the stem member 260 being spaced from the valve train assembly 50, a service tool or retaining device, such as an open ended wrench is position on the pair of flats 270. One end of the wrench is positioned between the legs 148 and on the pair of flats 270 and the other end of the wrench is maintained by a mechanic. A second wrench is positioned about the locking device 273 on the stem member 270 and the other end is maintained by the mechanic. Thus, the mechanic loosens the locking device 273. Or, as an alternative, an end of a wrench, such as an Allen wrench, is positioned in the countersunk hex configuration 276 in the second end 268 of the stem member 270 verses placing a wrench on the pair of flats 270. Thus, with the nut 273 loose, the stem member 260 can be rotate and the meshed threads of the threads on the center portion 174 of the stem member 260 and the threaded configuration of the second diameter 254 of the piston 230 allow the dimension of the axially length of the stem member 260 extending beyond the first end 236 of the body portion 232 of the piston 230 to be changed. This change further varies the clearance between the top surface 114 of the actuator pin 110 and the first end 264 of the stem member 260. After adjusting the axial length, the nut 273 is tightened on the threaded portion 272 and is placed in contacting relationship with the first end 244 of the stem portion 240 of the piston 230. Thus, the meshed threads of the threads on the center portion 174 of the stem member 260 are again maintained in highly frictional engagement with the threaded configuration of the second diameter 254 of the piston 230.

Thus, the present invention overcomes the adaptation of the compression braking system 120 to a conventional engine 10. The actuation of a single valve whiling using a pair of valve actuated by a bridge is overcome. And, fit-ups during assembly and wear of component within the engine 10 can be compensated therefor by adjusting the lineal distance of length of the actuator 136 relative to the clearance with respect to the actuator pin 110.

The present invention enables a conventional engine 10 to be adapted for use with a compression braking system 120 in a cost effective manner. For example, with the valve bridge 74 having the actuator pin 110 therein and with the threaded holes for the bracket 138 in the cylinder head 16, the compression braking system 120 can be added without varying other components of the conventional engine 10. And, wear or adjustment of the clearance between the actuator 136 and the end 42 of the valves 26,32 can be accomplished as stated above. Thus, the problems defined therein and others are overcome with this invention.

Other aspects, objects and advantages will become apparent from a study of the specification, drawings and appended claims.

What is claimed is:

1. An engine has a cylinder having a piston therein and a pair of valves operatively positioned relative to said piston, said pair of valves each having an end, each of said end being actuated by a valve bridge, said valve bridge moving said pair of valves between an open position and a closed position during an operating mode of said engine, said engine comprising:

a controller being operatively attached to said engine;

an actuator being attached to said engine, said actuator being spaced from said pair of valve a predetermined distance and said actuator having a stem member defining an end, said end being positioned opposite each of said end of said pair of valves and said actuator having a piston defining an end and a distance between said end of said stem member and said end of said piston being adjustable near said end of said stem member; and a one of said pair of valves being movable between an open position and a closed position by said actuator independently of said actuation of said pair of valves being actuated by said valve bridge.

2. The engine of claim 1 wherein said actuator being adjustable and said predetermined distance between said actuator and said pair of valves being a varied predetermined distance.

3. The engine of claim 1 wherein said stem member and said piston being threadedly attached.

4. The engine of claim 1 wherein said one of said pair of valves being movable between said open position and said closed position being an exhaust valve.

5. The engine of claim 1 wherein said valve bridge having an actuator pin positioned therein and said actuator slidably moving said actuator pin within said valve bridge.

6. The engine of claim 5 wherein said actuator pin defining an axis "APA" and having a top surface defining a preestablished cross-sectional area "TSCA" being positioned about said axis "APA".

7. The engine of claim 6 wherein said actuator having a stem member defining an axis "SMA" and having a first end defining a preestablished cross-sectional area "FECA" being positioned about said axis "SMA", and said axis "APA" and said axis "SMA" being generally aligned one with the other.

8. The engine of claim 7 wherein said cross-sectional area "TSCA" of said top surface of said actuation pin and said cross-sectional area "FECA" of said first end of said stem member overlap least a portion thereof.

* * * * *

UNITED STATES PATENT AND TRADEMARK OFFICE

CERTIFICATE OF CORRECTION

PATENT NO. : 6,474,296 B2
DATED : November 5, 2002
INVENTOR(S) : Sean O. Cornell et al.

It is certified that error appears in the above-identified patent and that said Letters Patent is hereby corrected as shown below:

Column 10,
Line 34, insert -- at -- after "overlap"

Signed and Sealed this

Fourth Day of March, 2003

JAMES E. ROGAN
*Director of the United States Patent and Trademark Office*